US005795503A

United States Patent [19]

Krake

[11] Patent Number: 5,795,503

[45] Date of Patent: Aug. 18, 1998

[54] FENCE POST AND RAIL CONNECTOR

[76] Inventor: Christopher P. Krake, 22500 NE. 128th Cir., Brush Prairie, Wash. 98606

[21] Appl. No.: 731,858

[22] Filed: Oct. 21, 1996

[51] Int. Cl.[6] ..... E04H 17/14

[52] U.S. Cl. ..... 256/65; 256/59; 256/19

[58] Field of Search ..... 256/65, 19, 59

[56] References Cited

U.S. PATENT DOCUMENTS

| | | | |
|---|---|---|---|
| 859,239 | 7/1907 | McFall | 256/19 X |
| 967,374 | 8/1910 | Hand | 256/19 X |
| 3,343,811 | 9/1967 | Kusel et al. | 256/65 X |
| 3,524,627 | 8/1970 | Boyanton et al. | 256/65 |
| 3,529,808 | 9/1970 | Siebers | 256/65 |
| 3,617,028 | 11/1971 | Bach | 256/19 |
| 4,101,226 | 7/1978 | Parisien | 256/65 X |
| 4,143,859 | 3/1979 | Tews | 256/49 |
| 4,286,772 | 9/1981 | Parisien | 256/65 |
| 4,289,302 | 9/1981 | Montgomery | 256/19 |
| 4,311,300 | 1/1982 | Buerger | 256/19 X |
| 4,519,586 | 5/1985 | Wilhelm et al. | 256/51 |
| 4,899,991 | 2/1990 | Brunkan | 256/24 X |
| 5,186,571 | 2/1993 | Hentzschel | 256/65 X |
| 5,575,580 | 11/1996 | Parrish et al. | 256/65 X |

*Primary Examiner*—Anthony Knight
*Attorney, Agent, or Firm*—James D. Givnan, Jr.

[57] ABSTRACT

A connector for attaching fence rails to posts including a clamp for placement about a post with each clamp serving to support a pair of rail ends. Each of the rail ends is fitted with a bracket having an upright flange for clamped engagement to a post surface. A modified bracket includes upper and lower flanges between which a rail end is received. The brackets may be of malleable construction to permit support of a fence rail in other than perpendicular relationship to an adjacent post. Each clamp includes a fastener assembly positionable opposite a rail end for partial concealment of the fastener assembly and clamp edges.

4 Claims, 1 Drawing Sheet

FENCE POST AND RAIL CONNECTOR

BACKGROUND OF THE INVENTION

The present invention pertains generally to fencing of the type utilizing posts of cementious material.

In the prior art is fencing wherein posts are formed of concrete, some of which include a central reinforcing member of steel. Examples of such posts are found in U.S. Pat. Nos. 967,374; 3,617,028; 4,143,859; 4,289,302 and 4,519,586. The posts disclosed in the patents require costly construction efforts for the support of fence rails. Such increased costs of manufacture offset the advantages achieved by concrete post construction to the extent that such posts are not in wide use at the present time. An additional drawback to known concrete post construction is the additional physical effort required to secure rail ends to concrete posts.

SUMMARY OF THE PRESENT INVENTION

The present invention is embodied in a connector assembly for a fence post and having clamp and bracket components for fence rail attachment.

In the present combination, a concrete post may be utilized which avoids the well known shortcomings attendant the use of wooden posts, the most significant being the deterioration of the buried segment of a post. The post component of the present combination is cast without requiring alteration for fence rail attachment. A novel clamp and bracket permits clamping of rail members to the post in a secure manner to provide durable fencing and a fence of attractive appearance. The combination embodied in the present invention permits convenient attachment of the fence rails to greatly simplify fence construction. The clamp component permits portions of same to be concealed by rail ends, yet allowing access to a clamp fastener. A range of rail configurations may be accommodated by the present clamping arrangement.

Important objectives of the present invention include the provision of a fence post and a connector assembly with clamp component for attaching fence rails provided with clamp engaged brackets; the provision of fence post which may be of other than wood material and a clamp attachable thereto for clamping bracket equipped fence rails in place on post surfaces; the provision of a clamp for fence post attachment to receive a flange of a rail mounted bracket inserted intermediate the clamp and post wall surface during fence assembly.

DETAILED DESCRIPTION OF THE PREFERRED EMBODIMENTS

Figure 1:
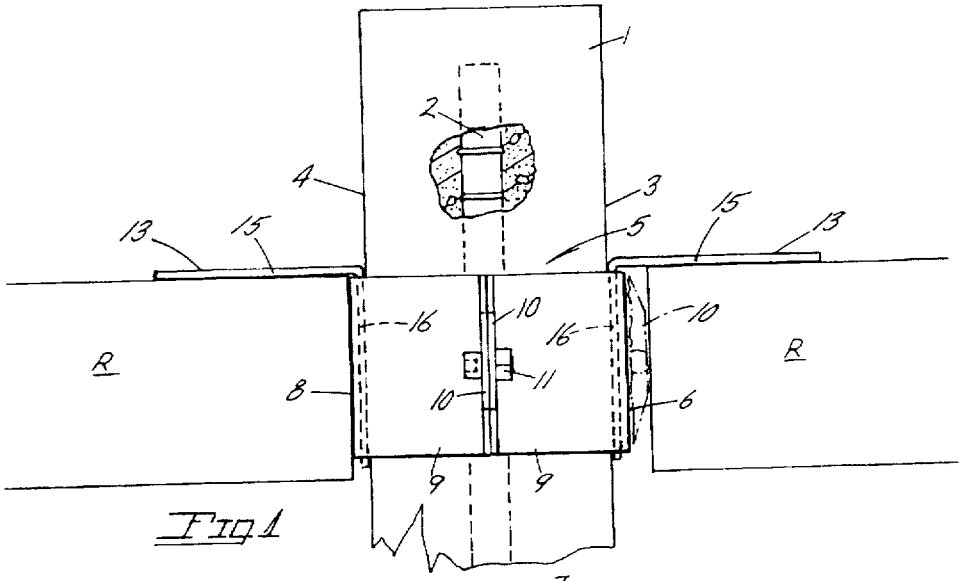
FIG. 1 is a fragmentary elevational view of a fence post with a clamp and rail mounted brackets in place thereon.

With continuing attention to the present drawings, wherein applied reference numerals indicate parts similarly hereinafter identified, the reference numeral 1 indicates a concrete fence post reinforced as by a reinforcing bar 2 preferably extending substantially the length of the post.

Post wall surfaces at 3 and 4 provide surface areas against which later described brackets abut.

Figure 2:
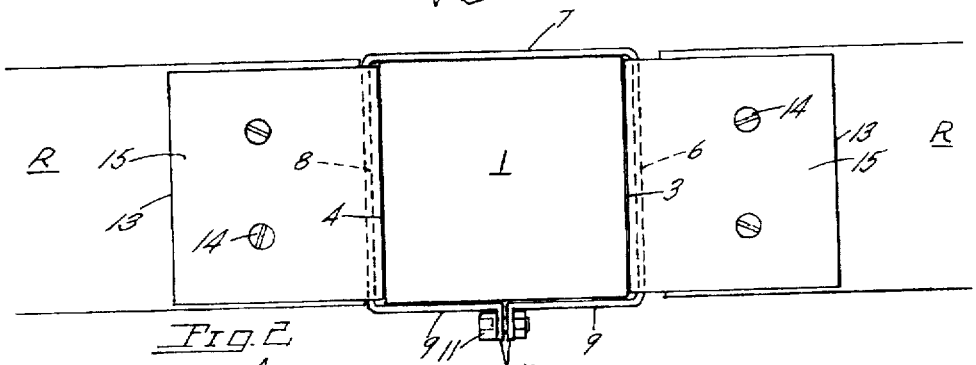
FIG. 2 is a plan view of FIG. 1.

In place about post 1 is a clamp indicated generally at 5 having a shape generally corresponding to the exterior of post 1. The clamp is formed with contiguous walls 6, 7, 8 and 9. Clamp wall 9 is segmented with each segment provided with an ear 10 apertured to receive a fastener assembly 11. Rails at R are carried by brackets 13 and receive fasteners at 14 to secure the brackets to the rail ends with each bracket having a horizontal flange 15 and an upright flange 16. In the form of the invention shown in FIGS. 1 and 2, the upright bracket flanges 16 are drawn into snug frictional engagement with post surfaces 3 and 4 upon tightening of fastener assembly 11.

For partial concealment of fastener 11 the segmented wall 9 of clamp 5 may be located adjacent to and opposite from a rail end and below a horizontal flange 15 of a bracket for concealment of fastener assembly 11 and clamp ears 10.

Figure 3:
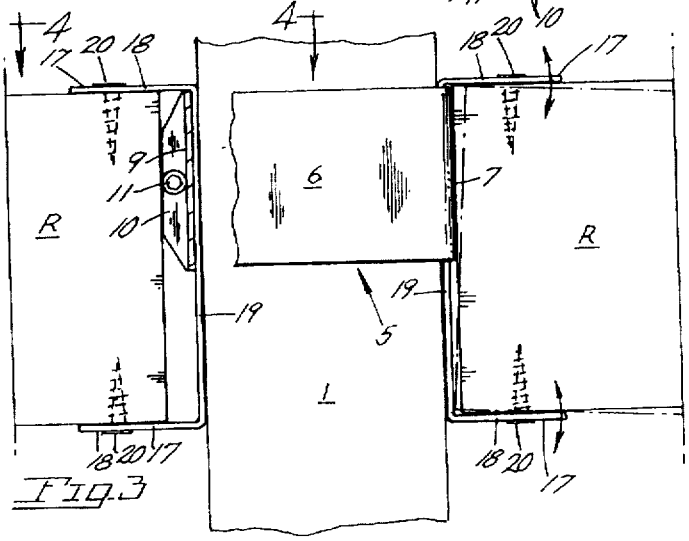
FIG. 3 is a view similar to FIG. 1 but showing modified brackets of the present combination.
Figure 4:
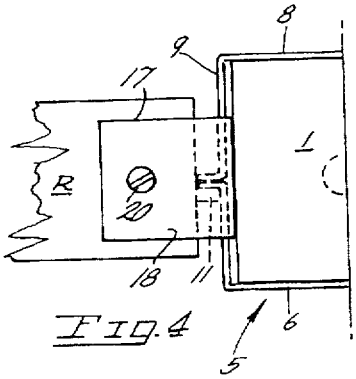
FIG. 4 is a plan view taken along line 4—4 of FIG. 3.

In FIGS. 3 and 4, double flange brackets 17 each of which includes a pair of upper and lower flanges 18 and upright flange 19. The double flange brackets permit installation of rails R when of greater vertical dimension and weight than that earlier mentioned. As shown in FIG. 3, upon the brackets being of malleable material such as galvanized metal, the horizontal flange 18 may be readily displaced to accommodate or permit slight inclination of a rail R to the horizontal, as for example, when the ground surface between two posts is other than horizontal. Upon the flanges being positioned to accommodate the inclined rail, the fasteners at 20 are seated.

While reference is made to concrete fence posts in the foregoing specification, it will be understood that the present invention is not limited to use therewith but rather may be used with posts of any material.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A connector assembly for attaching rails to a fence post and comprising, a clamp having contiguous walls and including fastener means for clamp placement about the post, one of said walls being segmented and having ears on said segments apertured for reception of said fastener means, said segmented wall and ears thereon positionable intermediate a rail end and the fence post to partially conceal the ears and fastener means, a bracket attachable to an end of the rail and having right angular flanges, one of said flanges insertable between said clamp and the post for surfacial abutment with the post, and said clamp upon fastener means actuation urging one of said contiguous walls toward said one of said flanges and the flange into frictional contact with the post to retain the rail end in place on the post.

2. The connector assembly claimed in claim 1 wherein said bracket includes an upright flange with upper and lower flanges thereon for engagement with upper and lower surfaces of one of the fence rails.

3. A connector assembly for attaching spaced apart ends of fence rails to a post, said assembly comprising, a clamp including a segmented wall with apertured ears, a fastener assembly received in said apertured ears, brackets each of right angular shape and having perpendicular flanges with one of said flanges attachable to a rail surface, said brackets of malleable material, a remaining flange of each bracket spaced from a rail end for insertion intermediate the clamp and the post, and said apertured ears and said fastener assembly of the clamp positionable subjacent said one of said flanges to partially conceal the fastener assembly.

4. A connector assembly for attaching rails to a fence post and comprising, a clamp having contiguous walls and including fastener means for clamp placement about the post, one of said walls being segmented and having ears on said segments apertured for reception of said fastener means, and a bracket attachable to an end of the rail and having right angular flanges, one of said flanges insertable between said clamp and the post for surfacial abutment with the post, said right angular flanges including at least one substantially horizontal flange for rail attachment, said bracket being of malleable metal to permit adjustment of the substantially horizontal flange out of right angular relationship with a remaining flange of the bracket to permit other than a perpendicular relationship between the fence post and rail when the fence rail is to be located above inclined terrain, said clamp upon fastener means actuation urging one of said contiguous walls toward said one of said flanges and the flange into frictional contact with the post to retain the rail end in place on the post.

* * * * *